US012297737B1

(12) United States Patent
Downton et al.

(10) Patent No.: US 12,297,737 B1
(45) Date of Patent: May 13, 2025

(54) BOTTOM HOLE ASSEMBLY HAVING THREE-POINT CONTACT FOR IMPROVED STEERING

(71) Applicant: Schlumberger Technology Corporation, Sugar Land, TX (US)

(72) Inventors: Geoffrey Charles Downton, Minchinhampton (GB); Riadh Boualleg, Gloucester (GB); Edward Richards, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/796,416

(22) Filed: Aug. 7, 2024

(51) Int. Cl.
*E21B 7/28* (2006.01)
*E21B 7/06* (2006.01)

(52) U.S. Cl.
CPC ..... *E21B 7/28* (2013.01); *E21B 7/064* (2013.01)

(58) Field of Classification Search
CPC ... E21B 7/04; E21B 7/06; E21B 7/064; E21B 7/046
See application file for complete search history.

(56) References Cited

U.S. PATENT DOCUMENTS

2008/0083567 A1* 4/2008 Downton ..... E21B 7/067 175/73
2008/0115974 A1* 5/2008 Johnson ..... E21B 7/06 175/325.2
2010/0006341 A1* 1/2010 Downton ..... E21B 7/064 175/73
2016/0084007 A1* 3/2016 Sugiura ..... E21B 17/1092 175/76
2020/0003011 A1* 1/2020 Sihler ..... E21B 7/068
2021/0040796 A1* 2/2021 Azar ..... E21B 17/10

* cited by examiner

*Primary Examiner* — David Carroll
(74) *Attorney, Agent, or Firm* — Jeffrey D. Frantz

(57) ABSTRACT

A system includes a bottom hole assembly (BHA) that includes a drill bit configured to drill a pilot hole in a subterranean formation, such that the drill bit provides a first point of contact between the BHA and the subterranean formation. The BHA includes a steering pad assembly that includes one or more steering pads each configured to move over a path of travel between a retracted position and an extended position to provide a second point of contact between the BHA and the subterranean formation, and a reamer configured to expand the pilot hole into a borehole, such that the reamer provides a third point of contact between the BHA and the subterranean formation. The system includes a controller configured to steer the BHA via the first, second, and third points of contact and adjustments to the second point of contact via control of the steering pad assembly.

18 Claims, 7 Drawing Sheets

BOTTOM HOLE ASSEMBLY HAVING THREE-POINT CONTACT FOR IMPROVED STEERING

BACKGROUND

The present disclosure generally relates to tools used to maneuver a drill bit while directional drilling for resource procurement.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

To meet consumer and industrial demand for natural resources, companies often invest significant amounts of time and money in searching for and extracting oil, natural gas, hydrocarbons, and other subterranean resources from the earth. Particularly, once a desired subterranean resource such as oil or natural gas is discovered, drilling and production systems are often employed to access and extract the resource. These systems may be located onshore or offshore depending on the location of a desired resource. Common methods include deploying the drilling and production systems on the surface or on a floating platform disposed above the discovered resources, and drilling a borehole straight down into the surface of the earth to procure the desired resource(s).

However, in some scenarios, desired resources may be located such that it is inconvenient to dispose the drilling and production systems on the surface directly above the resources. In these cases, it may be beneficial to set up the drilling and production systems in a location laterally spaced from the location of the desired resources and employ directional drilling techniques. While employing directional drilling techniques, operators are able to drill straight down below the surface of the earth, and then maneuver the drill bit to curve the drill bit along a prescribed arc to direct the drill bit towards the desired resources. Efforts to improve the efficiency and maneuverability of these drill bits during drilling operations may be advantageous.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

In certain embodiments, a system includes a bottom hole assembly (BHA) that includes a drill bit disposed at a first axial position such that the drill bit is configured to rotate and drill a pilot hole in a subterranean formation, such that the drill bit provides a first point of contact between the BHA and the subterranean formation. Additionally, the BHA includes a steering pad assembly disposed at a second axial position offset from the first axial position, such that the steering pad assembly includes one or more steering pads each configured to move over a path of travel between a retracted position and an extended position to provide a second point of contact between the BHA and the subterranean formation, and a reamer disposed at a third axial position offset from the first and second axial positions, such that the reamer is configured to expand the pilot hole into a borehole, such that the reamer provides a third point of contact between the BHA and the subterranean formation. Further, the system includes a controller of a rotary steerable system (RSS) configured to steer the BHA via the first, second, and third points of contact and adjustments to the second point of contact via control of the steering pad assembly.

In certain embodiments, a system includes a controller of a rotary steerable system (RSS) configured to control a bottom hole assembly (BHA) that includes a drill bit disposed at a first axial position, such that the drill bit is configured to rotate and drill a pilot hole in a subterranean formation, such that the drill bit provides a first point of contact between the BHA and the subterranean formation. Additionally, the BHA includes a steering pad assembly disposed at a second axial position offset from the first axial position, such that the steering pad assembly includes one or more steering pads each configured to move over a path of travel between a retracted position and an extended position to provide a second point of contact between the BHA and the subterranean formation, and a reamer disposed at a third axial position offset from the first and second axial positions, such that the reamer is configured to expand the pilot hole into a borehole, such that the reamer provides a third point of contact between the BHA and the subterranean formation. Additionally, the controller is configured to steer the BHA via the first, second, and third points of contact and adjustments to the second point of contact via control of the steering pad assembly.

In certain embodiments, a method includes controlling steering of a bottom hole assembly (BHA) via a controller of a rotary steerable system (RSS), such that the BHA includes a drill bit disposed at a first axial position, such that the drill bit is configured to rotate and drill a pilot hole in a subterranean formation, such that the drill bit provides a first point of contact between the BHA and the subterranean formation. Additionally, the BHA includes a steering pad assembly disposed at a second axial position offset from the first axial position, such that the steering pad assembly includes one or more steering pads each configured to move over a path of travel between a retracted position and an extended position to provide a second point of contact between the BHA and the subterranean formation, and a reamer disposed at a third axial position offset from the first and second axial positions, such that the reamer is configured to expand the pilot hole into a borehole, such that the reamer provides a third point of contact between the BHA and the subterranean formation. Additionally, the controller is configured to steer the BHA via the first, second, and third points of contact and adjustments to the second point of contact via control of the steering pad assembly.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness. These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
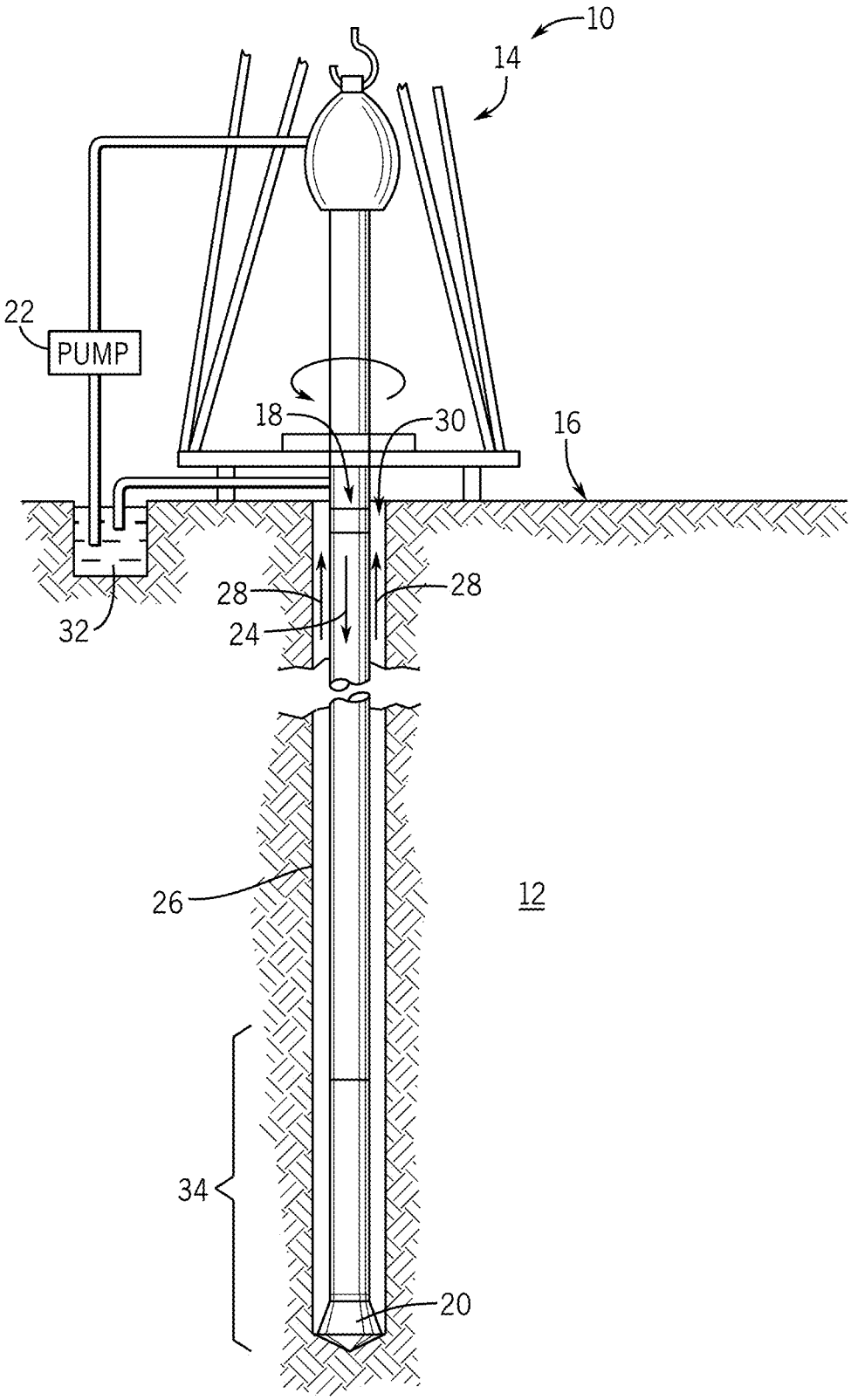
FIG. 1 is a schematic view of a drilling system including a downhole tool string, in accordance with aspects of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Certain terms are used throughout the description and claims to refer to particular features or components. As one skilled in the art will appreciate, different persons may refer to the same feature or component by different names. This document does not intend to distinguish between components or features that differ in name, but not function.

For decades, humans have relied on resources found below the earth's surface to meet increasing energy demands. These resources include but are not limited to natural gas, coal, hydrocarbons, petroleum, and other materials suitable to generate energy for consumption by humans. As energy demands increase, significant efforts are expended to extract an appropriate supply of energy to meet the increasing demand. Included in these efforts are systems and methods that enable expanded extraction of the resources, increases to the efficiency of the extraction process, and technological advances that permit extraction and exploration in areas that were previously inaccessible for energy production. Recently, one area of exploration that has grown with the advance of energy exploration related technology is the extraction of resources from a portion of the earth's surface where it is not feasible to dispose drilling and production facilities directly above the subterranean resources.

As one might expect, extracting resources from an area below the earth's surface without being able to drill straight down introduces additional challenges that might not necessarily be present when extracting resources from the earth in a conventional manner. For example, operators calculate a location for the drilling and production facilities sufficiently laterally spaced from the resources, and determine an arc profile path that they may then maneuver the drill bit and accompanying drill string along the determined path to approach the desired resources from the side, rather than from above. While traditional resource procurement systems may not require equipment configured to direct the drill bit along an arc-shaped path, directional drilling systems utilize an array of drill bits, valves, actuators, motors, seals, sensors, control systems, and other components that work together to enable the operator to direct the drilling components along the determined path through the subterranean formations. Methods for directional drilling and the arc profile paths taken during operation are constrained by the geometrical aspects of the equipment utilized during the directional drilling process. For example, certain length ratios and diameter ratios that characterize the components of the directional drilling techniques restrict the performance and the shape of the arcs an operator is allowed to chart for a particular directional drilling operation. Components of the directional drilling system that provide for relatively large bore sizes often limit the agility and maneuverability of the system, while alternatively, components that provide for increased agility and maneuverability often restrict the diameter of the borehole. As a result, efforts to improve the maneuverability and agility of the directional drilling system, while simultaneously providing for relatively large borehole sizes to increase production may be advantageous.

The present disclosure relates to a directional drilling system in which a drilling tool provides agile steering performance of a smaller diameter tool, while also configured to drill relatively large boreholes. Present embodiments include a bottom hole assembly (BHA) that includes a rotary steerable system (RSS) drilling tool and a reamer. In the present disclosure, the RSS drilling tool has a comparatively smaller diameter, and by extension, a smaller second moment of area, than traditional RSS drilling tools, thereby enabling the RSS drilling tool to drill a comparatively smaller diameter pilot hole along a tighter curved trajectory, as a result of its geometry. The RSS drilling tool includes a drill bit which provides a first point of contact and an assembly of steering pads which provide a second point of contact. In present embodiments, the RSS drilling tool is attached to the reamer, which is configured to provide a third point of contact in the borehole, which in combination with the first and second points of contact from the drill bit and steering pads, define the arc profile path. Also, the reamer is configured to centralize the tool in the borehole, open the borehole to a larger diameter, and follow the trajectory of the pilot hole cut by the RSS drilling tool. Additionally, present embodiments provide the operator the ability to enjoy the benefits of a more agile, maneuverable directional drilling system configured to drill tighter, more precise arc trajectories while drilling, while still opening up the borehole to a size suitable to maintain relatively high levels of resource production.

Turning to the drawings, FIG. 1 illustrates a drilling system 10 (e.g., subterranean drilling system) that may be used to drill a well through subterranean formations 12 to extract various fluids (e.g., oil, natural gas, or hydrocarbon containing fluids). In the illustrated embodiment, a drilling rig 14 at the surface 16 may rotate a drill string 18, which includes a drill bit 20 at its lower end to engage the subterranean formations 12. The drilling system 10 is configured to rotate the drill bit 20 to cut a vertical borehole 26 in the subterranean formations 12, and in certain embodiments, the drilling system 10 is configured to rotate the drill bit to cut a curved borehole in the subterranean formations 12. To cool and/or lubricate the drill bit 20, a drilling fluid pump 22 may pump drilling fluid 28, commonly referred to as "mud" or "drilling mud," from a mud pit 32, downward through the center of the drill string 18 in the direction of the arrow 24 to the drill bit 20. In addition to cooling and lubricating, as discussed in further detail below, the drilling fluid 28 may also facilitate the drill bit 20 turning and cutting the curved borehole. At the drill bit 20, the drilling fluid 28 may then exit the drill string 18 through ports (not shown) and flow into the borehole 26. While drilling, the drilling fluid 28 may be pushed toward the surface 16 through an annulus 30 between the drill string 18 and the formation 12, thereby carrying drill cuttings away from the bottom of the borehole 26. Once at the surface 16, the returned drilling fluid 28 may be filtered and conveyed back to the mud pit 32 for reuse. Additionally, the drilling fluid 28 may exert a mud pressure on the formation 12 to reduce likelihood of fluid from the formation 12 leaking into the borehole 26 and/or out to the surface 16. Further, a bottom hole assembly (BHA) 34 includes various components that operate together as part of the drilling system 10, as discussed in further detail below.

Figure 2:
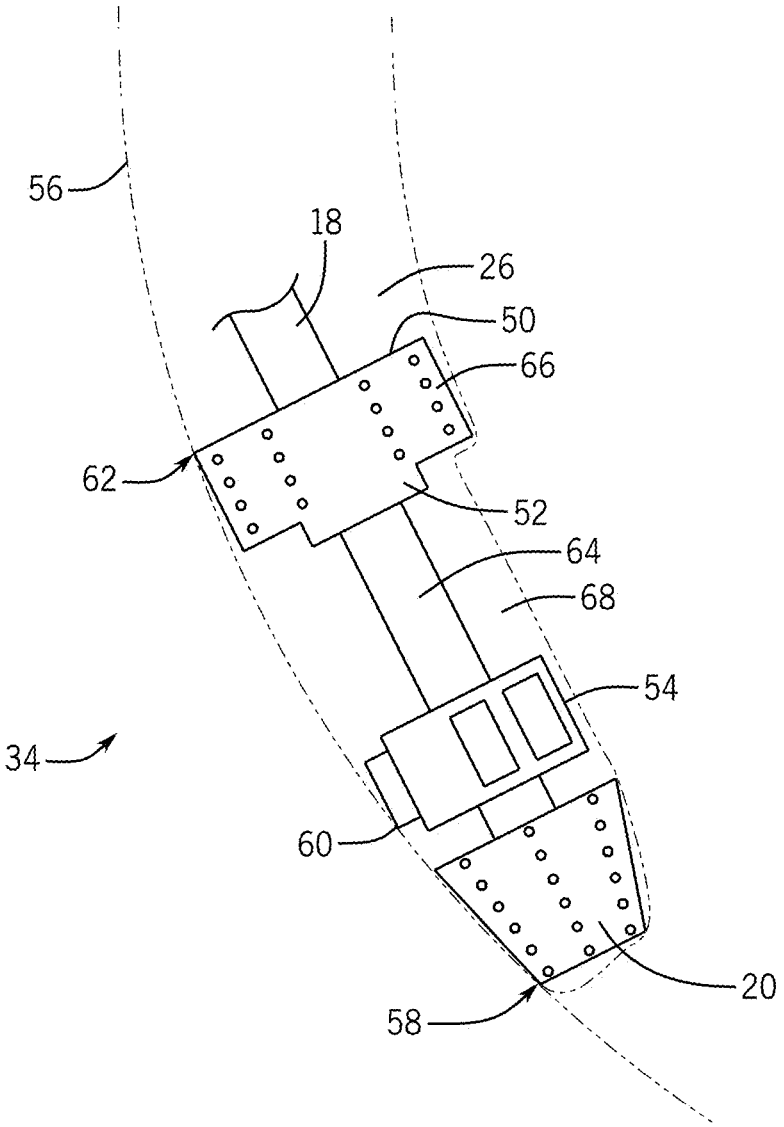
FIG. 2 is a schematic view of a rotary steerable system (RSS) tool and drill bit operating to drill a curved borehole, in accordance with aspects of the present disclosure.

As discussed above, the drilling system 10 may be configured to rotate the drill bit 20 to cut a curved, or an arc shaped path to reach subterranean resources that are not located directly below the drilling and production facilities. FIG. 2 illustrates an embodiment of the BHA 34 having a reamer 50 coupled to a rotary steerable system (RSS) tool 64 having the drill bit 20 and a steering pad assembly 54, wherein the drill bit 20, the steering pad assembly 54, and the reamer 50 provide a relatively compact arrangement of three points of contact 58, 60, 62 (e.g., only three axial positions of contact) for defining an arc shaped profile 56 for drilling. In certain embodiments, the BHA 34 excludes additional intermediate points of contact disposed axially between the three points of contact 58, 60, and 62. As used herein, the first point of contact 58 is axially centered along the drill bit 20, the second point of contact 60 is axially centered along the steering pad assembly 54, and the third point of contact 62 is axially centered along the reamer 50. In certain embodiments, the BHA 34 may include additional components as discussed in further detail below. The RSS tool 64 is configured to couple to the reamer 50 with a larger cutting diameter than the drill bit 20, which in turn is coupled to the drill string 18. Additionally or alternatively, the RSS tool 64 is configured to cut a pilot hole 68 for the borehole 26 by utilizing the drill bit 20 to engage with and drill through the subterranean formation 12. In cutting the pilot hole 68 for the borehole 26, the RSS tool 64 enables the reamer 50 to follow behind the RSS tool 64 and open the pilot hole 68 into a larger diameter borehole 26. In the illustrated embodiment, the drill bit 20, the steering pad assembly 54, and the reamer 50 each provide a point of contact with either the pilot hole 68 or the borehole 26.

As shown, the drill bit 20 provides a first point of contact 58 with the drilled pilot hole 68, the steering pad assembly 54 provides a second point of contact 60 with the drilled pilot hole 68, and the reamer 50 provides a third point of contact 62 with the borehole 26. Taken together, the three points of contact, 58, 60, 62 define the arc shaped profile 56 of the pilot hole 68 and borehole 26 cut by the drill bit 20 and reamer 50 respectively. As discussed above, the drill bit 20 engages with the subterranean formation 12 to cut the pilot hole 68 and provides the first point of contact 58 of the curved profile path. Additionally, the RSS tool 64 is configured to rotate with the drill string 18 and the drill bit 20, and as the RSS tool 64 rotates, the tool is configured to actuate the steering pad assembly 54 to steer and direct the drill bit 20. The steering pad assembly 54 is configured to radially extend and radially retract individual steering pads of the steering pad assembly 54 as it rotates as part of the RSS tool 64, and as an individual steering pad is radially extended, it contacts a wall of the pilot hole 68 cut by the drill bit 20. This contact between the individual steering pad and the pilot hole 68 acts as the second point of contact 60 defining the arc shaped profile. Additionally, the reamer 50 is configured to follow the path cut by the drill bit 20 and cut the borehole 26 to a larger diameter suitable for producing resources. The reamer 50 engages with the subterranean formation 12 and cuts the production hole and provides the third point of contact 62, that in conjunction with the first point of contact 58 and the second point of contact 60, defines the geometry and path of the arc shaped borehole profile.

In the illustrated embodiment, the three points of contact 58, 60, and 62 are axially spaced apart from one another over a relatively compact axial distance, such as less than or equal to 1, 1.5, 2, 2.5, or 3 meters rather than 4 to 5 meters or more. In other words, the three points of contact 58, 60, and 62 are different axial positions of contact, which span an overall axial distance including a first axial distance between the first and second points of contact 58 and 60 and a second axial distance between the second and third points of contact 60 and 62. By further example, the second point of contact 60 is positioned axially between the first and third points of contact 58 and 62, which are axially spaced less than or equal to 1, 1.5, 2, 2.5, or 3 meters. Thus, the three points of contact 58, 60, and 62 also may be described as axial contact positions, each of which may extend at least partially or entirely around a circumference of the BHA 34. Additionally, the third point of contact 62 is directly at the reamer 50 (e.g., integrated with the reamer 50), rather than relying on a third point of contact axially spaced apart from the reamer 50 at a further distance away from the first and second points of contact 58 and 60 (e.g., not further upstream along the drill string 18). For example, the BHA 34 having the three points of contact 58, 60, and 62 may exclude a stabilizer (e.g., providing a point of contact for the arc shaped profile 56) along the drill string 18 axially spaced further away from the reamer 50, such that the three points of contact 58, 60, and 62 span a shorter axial distance. Thus, the compact axial distance of the three points of contact 58, 60, and 62 enables greater maneuverability of the BHA 34, greater flexibility of the BHA 34, sharper turns or shorter radii of curvature of the arc shaped profile 56, and potentially faster response times when drilling through difficult subterranean formations.

The reamer 50 is coupled to the RSS tool 64 and the drill string 18, wherein the reamer 50 is a cutting structure configured to open or dress the pilot hole 68 into the borehole 26 that is a bit gauge diameter or larger. The reamer 50 may be rotationally coupled or fixed to the drill string 18 and/or the RSS tool 64. Thus, the reamer 50 may be configured to rotate directly with rotation of the drill string 18, and/or the RSS tool 64 may be configured to rotate directly with rotation of the drill string 18. The reamer 50 include a stabilizer portion 52 and a cutter portion 66. In certain embodiments, the reamer 50 may include one or more stabilizer portions 52 at upstream, downstream, and/or intermediate portions of the reamer 50 relative to the cutter portion(s) 66. In some embodiments, the stabilizer portion 52 may be permanently attached to (e.g., welded or integrally formed as one-piece with) the reamer 50, and in other embodiments, the stabilizer portion 52 may be removably coupled to the reamer 50 via one or more fasteners (e.g., screwed in place via threaded fasteners). The stabilizer portion 52 includes an outer circumferential surface (e.g., stabilizer surface) with a smaller diameter than the diameter of the outer circumferential surface (e.g., cutter surface) of the cutter portion 66 of the reamer 50. In other words, the cutter portion 66 radially protrudes relative to the stabilizer portion 52. In certain embodiments, the stabilizer portion 52 includes an annular stabilizer portion having a constant diameter around an annular surface of the reamer 50, a plurality of circumferentially spaced surfaces or ribs (e.g., axial surfaces or ribs, spiral surfaces or ribs, or both) spaced apart by intermediate grooves (e.g., axial and/or spiral grooves), or any combination thereof, with substantially smooth surfaces (e.g., excluding any cutting structures). Additionally, in certain embodiments, the cutter portion 66 may include a plurality of cutting elements made of wear resistant materials, such as diamond, tungsten carbide, or any combination thereof. The cutting elements may include a plurality of cutting projections, such as pointed projections, beads, cones, cylinders, or any combination thereof. For example, the cutter portion 66 may include at least 10 to 100 or more cutting elements. As discussed in further detail below, the reamer 50 may include any number and arrangement of the stabilizer portion 52 and the cutter portion 66; however, the stabilizer portion 52 and the cutter portion 66 may be directly integrated and/or directly adjacent (e.g., axially adjacent) one another in the reamer 50. In certain embodiments, the stabilizer portion 52 may be axially spaced from the cutter portion 66 by an axial distance of less than or equal to 1, 2, 3, 4, 5, 6, 7, 8, 9, 10, 15, 20, 30, 40, or 50 centimeters. In certain embodiments, the stabilizer portion 52 may be axially spaced from the cutter portion 66 by an axial distance of less than or equal to a factor of 0.1, 0.2, 0.3, 0.4, 0.5, 0.6, 0.7, 0.8, 0.9, 1.0, 1.5, or 2 times an outer diameter of the stabilizer portion 52. In certain embodiments, the stabilizer portion 52 and the cutter portion 66 are axially adjacent without any discernable axial spacing therebetween.

In the illustrated embodiment, the stabilizer portion 52 of the reamer is configured to prevent deviation from the directed path and maintain the trajectory of the reamer 50, so that it may follow the path of the pilot hole 68. The cutter portion 66 of the reamer 50 includes an outer circumferential surface that includes multiple blades or cutting elements configured to drill the subterranean formation 12. In certain embodiments, the cutter portion 66 of the reamer 50 may include multiple outer circumferential surfaces, each with different diameters. In other embodiments, the cutter portion 66 of the reamer 50 has an outer circumferential surface with a substantially constant diameter. In certain embodiments, the stabilizer portion 52 and the cutter portion 66 of the reamer 50 are fixed together or continuously formed as a one-piece structure, or the stabilizer portion 52 and the cutter portion 66 of the reamer 50 are removably coupled together as a multi-piece structure.

Figure 3:
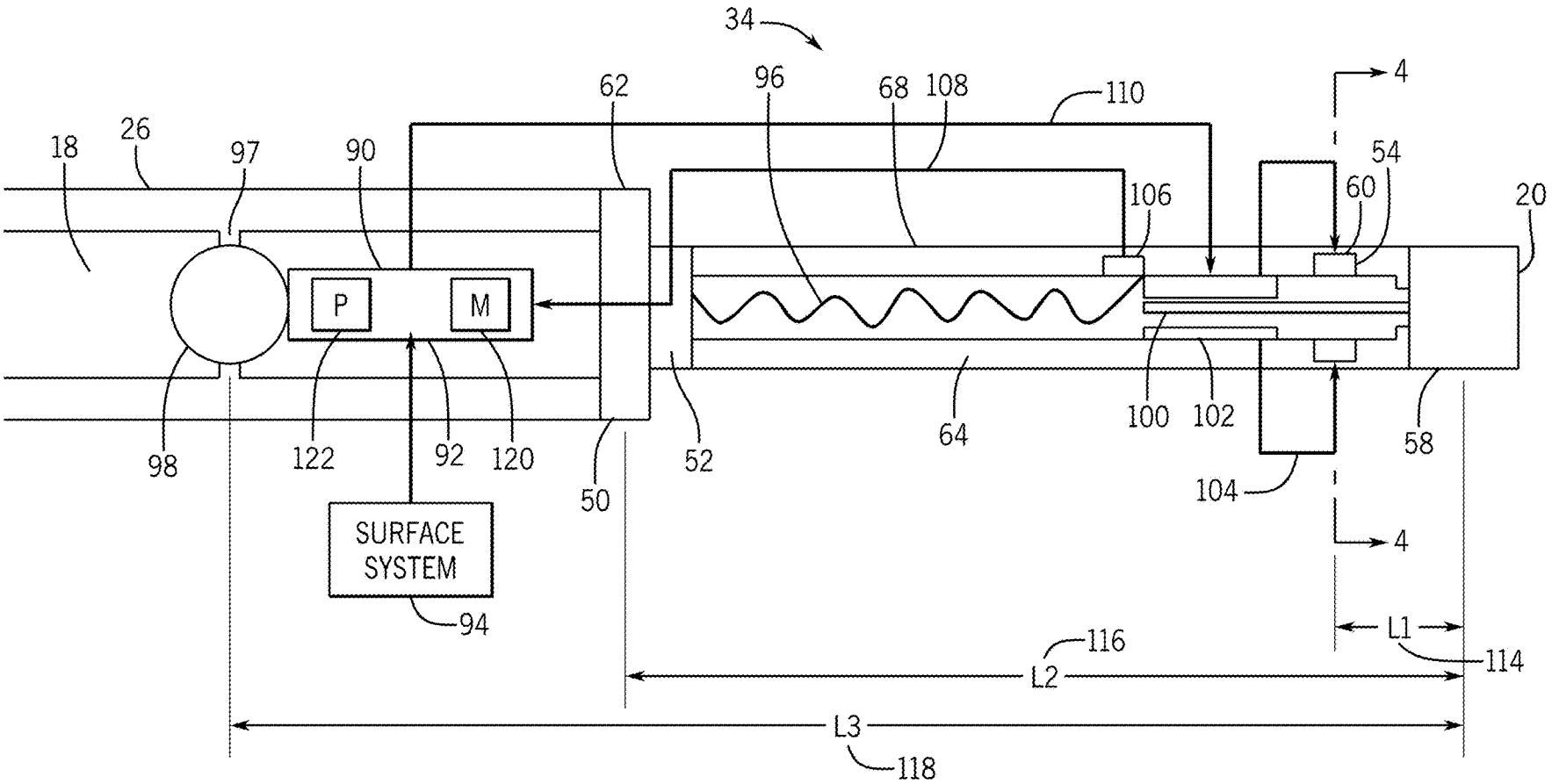
FIG. 3 is a schematic view of the RSS tool and reamer, in accordance with aspects of the present disclosure.

FIG. 3 illustrates a schematic view of an embodiment of the RSS tool 64 and its associated components, further illustrating the three points of contact 58, 60, and 62 provided by the drill bit 20, the steering pad assembly 54, and the reamer 50 for defining the arc shaped profile 56 for maneuverable directional drilling. As discussed above, the RSS tool 64 includes the drill bit 20 that cuts a curved pilot hole 68 along a curved path. In the illustrated embodiment, the RSS tool 64 is coupled to a reamer 50, which in turn is coupled to the drill string 18. In the illustrated embodiment, the drill string 18 includes a steering control unit 90, which further includes a steering controller 92. The steering control unit 90 is configured to fluidly connect the drilling fluid 28 with mud control valves 102 in the RSS tool 64 to facilitate steering operations performed by the RSS tool 64. The steering controller 92 includes a processor 122, a memory 120, and instructions stored on the memory 120 and executable by the processor 122 to control various components of the RSS tool 64. In the illustrated embodiment, the steering controller 92 communicatively couples to a forward sensor package 106, the mud control valves 102, and to a surface system 94. Furthermore, in a non-limiting embodiment, the steering controller 92 outputs data/control signal(s) 110 to the mud control valves 102, receives input data/input signal(s) from the surface system 94 and receives sensor data 108 from the forward sensor package 106. The steering controller 92 may be configured to receive an input from an operator in the drilling and production facilities on the surface 16, via the surface system 94, and then output instructions (e.g., data/control signal(s) 110), via the processor 122 and memory 120, to the mud control valves 102 to facilitate steering of the RSS tool 64.

In the illustrated embodiment, the RSS tool 64 includes the steering pad assembly 54. The mud control valves 102 are fluidly coupled to the steering pad assembly 54 by pressurized mud lines 104 (e.g., fluid conduits) that are configured to provide pressurized drilling fluid 28 to the steering pad assembly 54. As discussed in further detail below, the steering pad assembly 54 rotates with the drill bit 20 and is configured to actuate at least one steering pad from the steering pad assembly 54, such that the steering pad may radially extend and radially retract during operation. The mud control valves 102 are configured to provide the drilling fluid 28 to the steering pad assembly 54 via the pressurized mud lines 104, and in certain embodiments, each valve as part of the mud control valves 102 is fluidly connected to a respective steering pad of the steering pad assembly 54 via an individual pressurized mud line 104. In some embodiments, the steering controller 92 outputs instructions to the mud control valves 102 to automatically distribute pressurized drilling fluid 28 through the pressurized mud lines 104. In certain embodiments, the steering controller 92 is configured to control the mud control valves 102 to selectively provide mud to one or more steering pads of the steering pad assembly 54, thereby controlling which steering pad is actuated and a degree of actuation (e.g., radial extension or retraction) of the particular steering pad of the steering pad assembly 54. In this manner, the steering controller 92 is configured to control the second contact point 60 provided by the steering pad assembly 54, such that the steering controller 92 controls the second contact point 60 in combination with the first contact point 58 provided by the drill bit 20 and the third contact point 62 provided by the reamer 50 to define the arc shaped profile 56 for maneuverable directional drilling.

During steering and drilling operations, the steering control unit 90 is configured to receive sensor data 108 from the forward sensor package 106. In certain embodiments, the forward sensor package 106 includes multiple sensors configured to monitor operating parameters of the drilling fluid in the RSS tool (e.g., drilling fluid pressure, drilling fluid flow rate, etc.) during the drilling operation. The steering control unit 90 and the steering controller 92 may receive these operational parameters and output these parameters to the surface 16 via the surface system 94. In certain embodiments, the steering control unit 90 may be configured to automatically adjust the various operating parameters during the drilling operation in order to facilitate the drilling operations.

In certain embodiments, the RSS tool 64 may include or exclude a mud motor 96 and a transmission 100. In the illustrated embodiment, the RSS tool 64 includes the mud motor 96 and the transmission 100. The mud motor 96 may be an electric motor, a fluid-driven motor (e.g., driven by fluid flow of mud), or a combination thereof. In certain embodiments, the mud motor 96 is a fluid-driven motor having a spiral or helical flow path along a shaft (e.g., a helical or spiral shaft). However, a variety of fluid-driven motors may be used for the mud motor 96, and some embodiments of fluid-driven motors may have relatively shorter lengths suitable for reducing an overall length of the BHA 34. The mud motor 96 is configured to provide rotational energy to the drill bit 20 during drilling operations, such that the mud motor 96 can adjust (e.g., increase or decrease) drilling speeds, and also helps to balance the weight transmitted by the reamer 50 to the drill bit 20. In this way, the mud motor 96 enables the drill bit 20 and RSS tool 64 to prevent overloading of the drill bit in situations where the drill bit 20 diameter is significantly smaller than the reamer 50. Additionally or alternatively, the mud motor 96 may couple to the transmission 100, which is configured to receive a rotational energy (e.g., rotational speed RPM and torque, etc.) from the mud motor 96, and output a modified rotational energy to the drill bit 20. For example, if during a portion of the drilling operation a higher relative torque and lower relative rotational speed at the drill bit 20 is advantageous to better cut through the subterranean formation 12, the transmission 100 is configured to receive the rotational energy output from the mud motor 96, and adjust the rotational energy output such that the torque is increased, thereby decreasing the rotational speed at the drill bit 20. Additionally or alternatively, during an additional portion of the drilling operation a relatively higher rotational speed and lower relative torque at the drill bit 20 is advantageous to better cut through the subterranean formation 12, the transmission 100 is configured to receive the rotational energy output from the mud motor 96, and adjust the rotational energy output such that the rotational speed is increased, thereby decreasing the torque at the drill bit 20. The transmission 100 may include a plurality of gears and shafts of varying diameters and configurations, such that when these aforementioned adjustments are desired, the transmission 100 is configured to adjust a configuration of the gears and shafts to manipulate the output rotational energy from the mud motor 96 into an appropriate rotational energy profile at the drill bit 20. In certain embodiments, the mud motor 96 and the transmission 100 are controlled by the surface system 94 such that the user in the drilling and production facilities may output instructions to the mud motor 96 and transmission 100. In other embodiments, the mud motor 96 and transmission may be automatically controlled by the steering controller 92, and the parameters and configurations of the mud motor 96 and the transmission 100 may be dynamically adjusted in response to information from the sensor data 108. However, in certain embodiments, the mud motor 96 and the transmission 100 may be excluded to reduce a length of the BHA 34, thereby helping to improve maneuverability via the RSS tool 64.

In the illustrated embodiment, the reamer 50 includes a pivot joint 98 (e.g., rotational axis crosswise to a longitudinal axis of the drill string 18). The pivot joint 98 is disposed within the reamer 50, axially upstream or above the reamer 50, and/or axially upstream or above the RSS tool 64. For example, in certain embodiments, the pivot joint 98 may be integrally formed or fixed to the reamer 50 as part of a one-piece structure (i.e., unitary self-contained structure), or the pivot joint 98 may be removably coupled directly to the reamer 50. By further example, the pivot joint 98 may be disposed in any suitable location or distance from the reamer 50. During drilling operations, due to the nature of the RSS tool 64 and the reamer 50 cutting a curved borehole, a bending moment may be generated in a portion of the drill string 18 located above the reamer 50. In certain embodiments, the pivot joint 98 may be configured to alleviate such bending moments, and enable the RSS tool 64 and reamer 50 to cut a curved borehole with a tighter radius than otherwise possible. The pivot joint 98 may be configured to mechanically couple the drill string 18 to the reamer 50, while simultaneously enabling the reamer 50 and the RSS tool 64 to pivot in relation to the remainder of the drill string 18. The placement of the pivot joint in relation to the points of contact 58, 60, 62 between the RSS tool 64 and reamer 50 and the pilot hole 68 and borehole 26 respectively determine an effectiveness of the pivot joint in alleviating such bending moments. In the illustrated embodiment, a distance L3 118 is defined as the distance between the first contact point 58 axially centered on the drill bit 20 and a fourth contact point 97 axially centered on the pivot joint 98. As the value of L3 increases, the pivot joint 98 is enabled to reduce a greater portion of an associated bending moment generated as a result of the directional drilling operation. Alternatively, as the value of L3 decreases, the pivot joint 98 is enabled to reduce a smaller portion of the associated bending moment generated as a result of the directional drilling operation. In certain embodiments, the length L3 118 may be less than or equal to 2, 2.5, 3, 3.5, or 4 meters, wherein an axial distance between the third and fourth points 62 and 97 is less than 0.5, 1, 1.5, or 2 meters. However, in certain embodiments, the length L3 and the axial distance may be greater or lesser than the foregoing examples.

As discussed previously, the drill bit 20, the steering pad assembly 54 and the reamer 50 provide the first, second, and third points of contact 58, 60, 62 along the pilot hole and borehole necessary to define the arc of the curved path cut during the directional drilling operations. As a result, the associated lengths between the drill bit 20, the steering pad assembly 54, and the reamer 50 and the corresponding points of contact determine a radius of curvature of the pilot hole 68 drilled by the drill bit 20, and the associated radius of curvature of the borehole 26 cut by the reamer 50 as it follows the drill bit 20. For example, the length L1 114 between the drill bit 20 and the steering pad assembly 54, plays a role in determining the radius of curvature. The smaller the value of L1 114, the tighter the radius of curvature of the pilot hole 68 the RSS tool 64 is able to cut. In some embodiments, the steering pad assembly 54 may be disposed directly adjacent to the drill bit 20, thereby reducing the value of L1 114 to a value of zero. Additionally or alternatively, as the value of L1 114 increases, the value of the corresponding radius of curvature that the RSS tool 64 may cut in the pilot hole 68 increases. In certain embodiments the steering pad assembly 54 may be adjusted axially along the direction of the drill string 18, thereby adjusting the value of L1 114 to further adjust the radius of curvature of the pilot hole 68 drilled by the drill bit 20. In certain embodiments, the RSS tool 64 may include an adjustable bend portion configured to help steer the BHA 34. The adjustable bend portion may provide the second point of contact alone or in combination with the steering pad assembly 54.

Furthermore, the length L2 116 between the drill bit 20 and the reamer 50 factors into the performance of the RSS tool 64 and the reamer 50. As illustrated, the corresponding length L2 116 plays a role in determining the radius of curvature of the pilot hole 68. As the value of L2 116 decreases, the RSS tool 64 and drill bit 20 are enabled to drill the pilot hole 68 with a tighter radius of curvature. Additionally or alternatively, as the value of L2 116 increases, the RSS tool 64 and the drill bit 20 are enabled to drill the pilot hole 68 with a greater radius of curvature. Further, a ratio between L1 114 and L2 116 (e.g., ratio of L1/L2) may be established to define a relationship between the multiple points of contact that define the radius of curvature between the components of the RSS tool 64 and the reamer 50. For example, in certain embodiments that may exclude the mud motor 96, the length L2 116 may be less than or equal to 1, 1.5, 2, 2.5, or 3 meters rather than 4 to 5 meters or more. In certain embodiments that include the mud motor 96, the length L2 may be longer than 5 meters. In other embodiments, depending on a configuration of the various components discussed above, the length L2 116 may be between about 1 to 2.5 meters or 1.5 to 2 meters. By further example, the length L2 116 may be less than or equal to a factor of about 4, 5, 6, 7, 8, 9, or 10 times an outer diameter of the reamer 50. In certain embodiments, the ratio of L1/L2 may be less than 0.2, 0.3, 0.4, 0.5, 0.6, or 0.7, and/or the ratio L1/L2 may range between about 0.1 to 0.6 or 0.2 to 0.5. In certain embodiments, the ratio L1/L2 is fixed and thus not adjustable during operation. However, in certain embodiments, the steering control 92 may be configured to control an axial positioner coupled to the steering pad assembly 54, thereby adjusting an axial position of the steering pad assembly 54 and varying the ratio L1/L2 to provide more flexible steering of the BHA 34. In other words, the various examples provided above for lengths L1 114, L2 116, and L3 118 depend on various configurations of the components detailed above. Exclusion of the mud motor 96 may generally result in shorter lengths, whereas inclusion of the mud motor 96 may generally result in longer lengths. Accordingly, in certain embodiments, the lengths L1 114, L2 116, and L3 118 and ratios may be greater or lesser than the foregoing examples.

Figure 4:
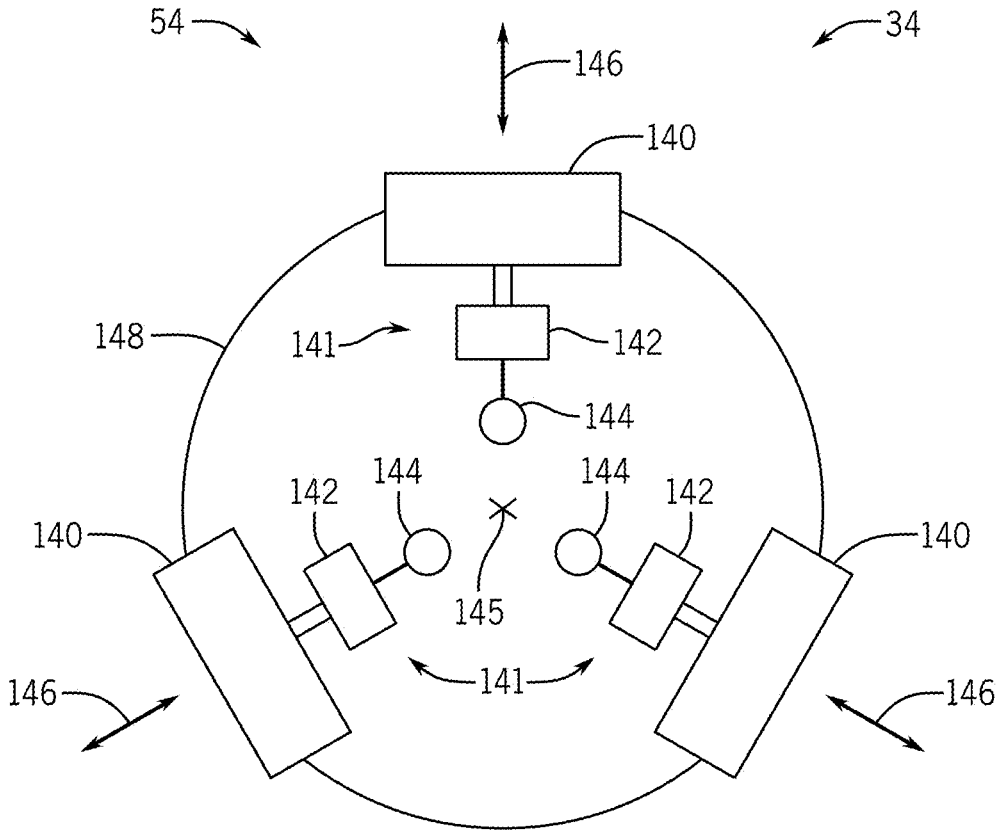
FIG. 4 is a section view through an embodiment of a steering pad assembly, in accordance with aspects of the present disclosure.

FIG. 4 illustrates a schematic cross-sectional view of an embodiment of the steering pad assembly 54, further illustrating aspects of the steering pad assembly 54 that provide the second point of contact 60. As illustrated, the steering pad assembly 54 includes a plurality of steering pads 140, with each steering pad 140 coupled to a steering pad drive or actuator 141 configured to radially adjust (e.g., radially extend or radially retract) the steering pad 140 in response to control by the steering controller 92. In particular, the steering controller 92 may be configured to control the steering pad drive or actuator 141 for each steering pad 140 independently, such that the desired steering pad 140 can be actuated to adjust the second point of contact 60. The steering pad drive or actuator 141 may include an electric drive (e.g., electric or digital actuator), a fluid drive (e.g., driven by mud, hydraulic fluid, or other fluid), or any combination thereof. In the illustrated embodiment, the steering pad drive or actuator 141 includes a fluid drive comprising a respective steering pad piston-cylinder assembly 142 (e.g., piston that reciprocates with a cylinder) and a steering pad valve 144. In the illustrated embodiment, the steering pad assembly 54 includes three (3) steering pads 140. However, a steering pad assembly 54 with fewer or more (e.g., 2, 4, 5, 6, 7, 8, etc.) steering pads 140 is considered within the scope of the various embodiments of the present disclosure. As discussed in further detail below, each steering pad 140 is configured to actuate along a direction of movement 146 (e.g., radial path of travel oriented in a radial direction relative to a central axis 145 of the BHA 34) that corresponds to the individual steering pad 140. In the illustrated embodiment, the direction of movement 146 of each steering pad 140 is normal to an outer surface 148 of the RSS tool 64. Additionally or alternatively, the steering pad 140 is configured to actuate along a path substantially aligned with the indicated direction of movement 146. At one end of the path, the steering pad 140 may protrude outside of the outer surface 148 (e.g., annular exterior surface or wall) of the RSS tool 64 and at an opposite end of the path, the steering pad may retract within the outer surface 148 of the RSS tool 64.

The steering pad piston-cylinder assembly 142 and the steering pad valve 144 function together to control the actuation of the steering pad 140 along the path and the illustrated direction of movement 146. In a non-limiting embodiment, the steering pad valve 144 is fluidly coupled to a mud control valve via a pressurized mud line. The steering pad valve 144 is configured to receive drilling fluid from the mud control valve and the pressurized mud line, and thereby output the received drilling fluid to the steering pad piston in order to actuate the steering pad 140 along the movement path from a radially retracted position to a radially protruded position. In certain embodiments, the steering pad valve 144 is configured to direct drilling fluid to a first side of a piston of the steering pad piston-cylinder assembly 142 to actuate the piston to push the steering pad 140 into a radially protruded position. Additionally, the steering pad valve 144 is configured to direct drilling fluid to a second side of the piston of the steering pad piston-cylinder assembly 142 to actuate the piston to pull the steering pad 140 into a radially retracted position. In other embodiments, the steering pad valve is configured to receive pressurized oil, and thereby output the received pressurized oil to the steering pad piston in order to actuate the steering pad 140 along the movement path from a radially retracted position to a radially protruded position.

In a non-limiting embodiment, as the steering pad assembly 54 rotates with the drill bit 20 and the RSS tool 64, the steering pad assembly 54 is configured to actuate the steering pad valve 144 and steering pad piston-cylinder assembly 142 to drive the movement of the steering pad 140. For example, the steering pad assembly 54 actuates an individual steering pad 140 to push against the wall of the pilot hole 68 cut by the drill bit 20, thereby causing the drill bit 20 to cut the pilot hole 68 with a determined radius of curvature. As a result, the steering pad assembly 54 actuates the steering pad 140 to protrude and provide the second point of contact 60 between the pilot hole 68 and the RSS tool 64. In a non-limiting embodiment, the steering pad assembly 54 may actuate the steering pad 140 to radially protrude at a point of the rotation, such that the steering pad 140 radially extends at a position opposite of the cutting path of the drill bit 20. In some embodiments, the steering pad assembly 54 may be rotationally decoupled from the drill bit 20 and the RSS tool 64, and the steering pad assembly 54 may be mounted on a rotationally fixed sleeve. In some embodiments, the steering pad assembly 54 may be mounted on a sleeve that is configured to rotate independently from the drill bit 20 and the RSS tool 64.

Figure 5:
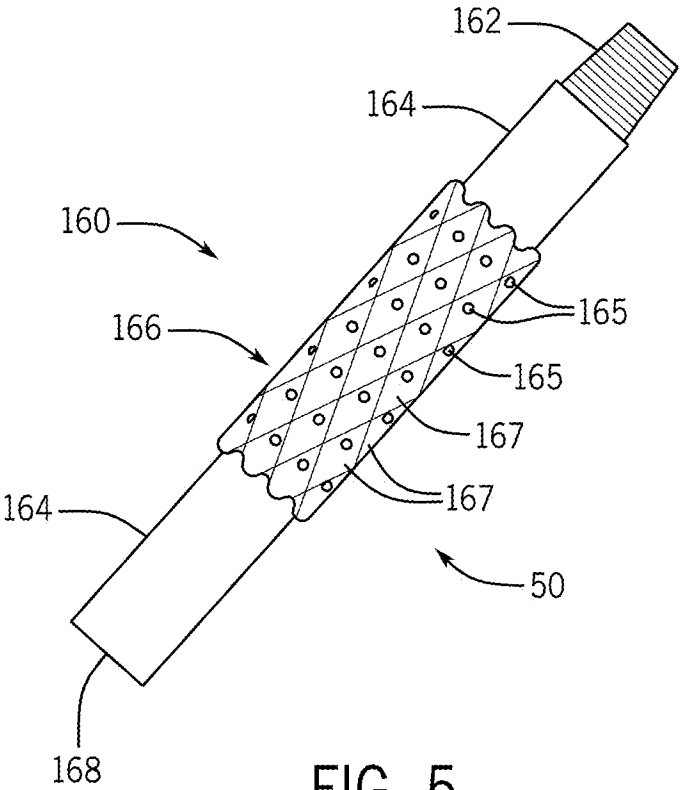
FIG. 5 is a perspective view of an embodiment of a fixed reamer, in accordance with aspects of the present disclosure.

FIG. 5 illustrates a perspective view of an embodiment of the reamer 50 of the BHA 34 of FIGS. 1-4, further illustrating a fixed diameter reamer 160 that may be employed as the reamer 50 to provide the third point of contact 62. The fixed diameter reamer 160 includes a stabilizer portion 164, a cutting portion 166, a pipe thread connection 162, and a bottom connection 168 to the RSS tool 64. In the illustrated embodiment, the stabilizer portion 164 is disposed at least axially below or upstream from the cutting portion 166 with respect to a direction of drilling; however, the stabilizer portion 164 also may be disposed axially above or downstream from the cutting portion 166. In other words, the stabilizer portion 164 may be disposed on only one side or on axially opposite sides of the cutting portion 166. The stabilizer portion 164 may be a cylindrical or annular stabilizer having a smooth annular surface with a constant diameter. As the name suggests, the cutting portion 166 of the fixed diameter reamer 160 has a constant diameter over an axial length of the cutting portion 166. The cutting portion 166 may be a generally annular structure having a plurality of cutting elements 165 and grooves 167 spaced throughout the cutting portion 166. The cutting elements 165 may include radial projections in a pattern around a circumference of the fixed diameter reamer 160, wherein the cutting elements 165 may be constructed with a wear resistant material (e.g., diamond, tungsten carbide, etc.) In certain embodiments, the stabilizer portion 164, the cutting portion 166, or a combination thereof, of the fixed diameter reamer 160 is configured to provide the third point of contact 62 between the borehole and the drilling equipment, thereby enabling the RSS tool 64 and drill bit 20 to engage in directional drilling techniques.

In a non-limiting embodiment, the fixed diameter reamer 160 includes a pipe thread connection 162 and a bottom connection 168 configured to interface with the RSS tool 64. The pipe thread connection 162 is configured to interface with the drill string 18, and may include pipe threads, or any other suitable coupling interface to couple the fixed diameter reamer 160 to the drill string 18. In certain embodiments, the pipe thread connection 162 is configured to removably couple the fixed diameter reamer 160 to the drill string 18, such that the fixed diameter reamer 160 rotates with the drill string 18. The bottom connection 168 is configured to include pipe threads, or any other suitable coupling interface, to couple the fixed diameter reamer 160 to the RSS tool 64. In some embodiments, the bottom connection 168 is configured to rotatably couple the fixed diameter reamer 160 to the RSS tool 64, thereby enabling the RSS tool 64 to rotate independently of the fixed diameter reamer 160.

Figure 6:
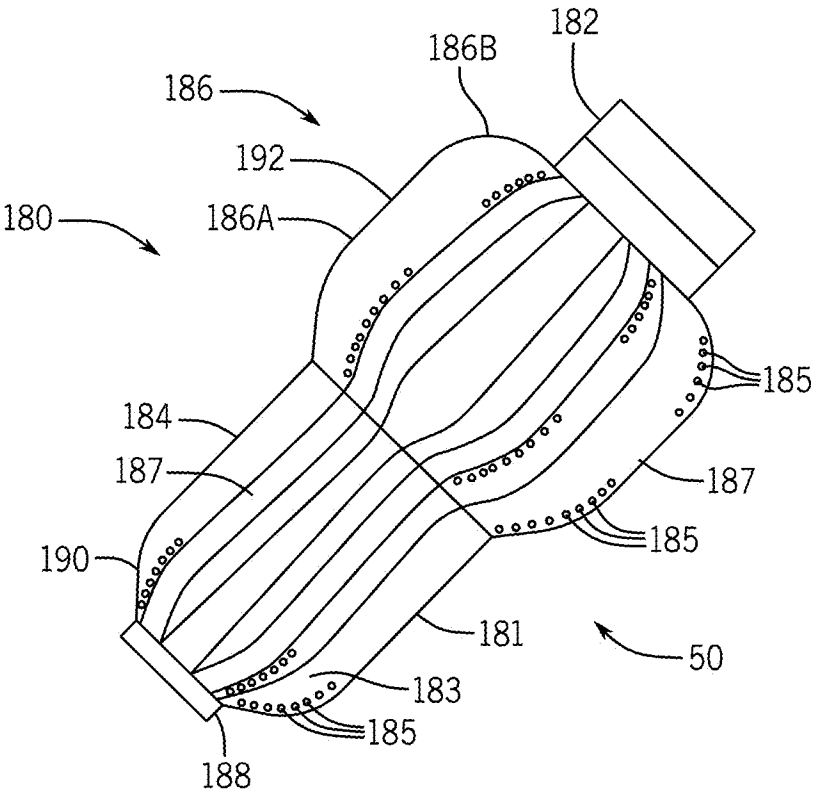
FIG. 6 is a perspective view of an embodiment of a staged hole opener reamer, in accordance with aspects of the present disclosure.

FIG. 6 illustrates a perspective view of an embodiment of the reamer 50 of the BHA 34 of FIGS. 1-4, further illustrating a staged hole opener 180 that may be employed as the reamer 50 to provide the third point of contact 62. The staged hole opener 180 includes a first stage cutting portion 190, a first intermediate stabilizer portion 184, a second stage cutting portion 186, a second intermediate stabilizer portion 192, a pipe thread connection 182, and a bottom connection 188 to the RSS tool 64. In the illustrated embodiment, the first intermediate stabilizer portion 184 is disposed axially between the first stage cutting portion 190 and the second stage cutting portion 186 of the staged hole opener 180. Additionally, in the illustrated embodiment, the second intermediate stabilizer portion 192 is disposed axially between cutting portions 186A and 186B of the second stage cutting portion 186 of the staged hole opener 180. The staged hole opener 180 includes a plurality of axial ribs 181 and a plurality of axial grooves 183 spaced circumferentially about the staged hole opener 180 through the first stage cutting portion 190, the first intermediate stabilizer portion 184, the second stage cutting portion 186, and the second intermediate stabilizer portion 192. The first and second stage cutting portions 190 and 186 include a plurality of cutting elements 185 disposed on the plurality of axial ribs 181, wherein the plurality of cutting elements 185 may include radial projections made of a wear resistant material (e.g., diamond, tungsten carbide, etc.). In contrast, the first and second intermediate stabilizer portions 184 and 192 includes a smooth surface 187 (e.g., without any cutting elements). As the name suggests, the first stage cutting portion 190 is configured to open the borehole to a first diameter in a first reamer stage of the drilling operation, and the second stage cutting portion 186 is configured to open the borehole to a second diameter (e.g., larger than the first diameter) in a second reamer stage of the drilling operation. In certain embodiments, the second diameter is at least 1.2, 1.3, 1.4, 1.5, 2, 2.5, or 3 times the first diameter.

In certain embodiments, the staged hole opener 180 is configured to use the first intermediate stabilizer portion 184 and/or the second intermediate stabilizer portion 192 to provide the third point of contact 62, such that the third point of contact 62 is an average or axially central position along the staged hole opener 180. In some embodiments, given that the second intermediate stabilizer portion 192 has a larger diameter than the first intermediate stabilizer portion 184, the second intermediate stabilizer portion 192 may be used to define the third point of contact 62. In either case, the staged hole opener 180 (e.g., reamer 50) defines the third point of contact 62 rather than relying on a separate stabilizer away from the reamer 50.

In a non-limiting embodiment, the staged hole opener 180 includes a pipe thread connection 182 and a bottom connection 188 configured to interface with the RSS tool 64. The pipe thread connection 182 is configured to interface with the drill string 18, and may include pipe threads, or any other suitable coupling interface to couple the staged hole opener 180 to the drill string 18. In certain embodiments, the pipe thread connection 182 is configured to couple the staged hole opener 180 to the drill string 18, such that the staged hole opener 180 rotates with the drill string 18. The bottom connection 188 is configured to include pipe threads, or any other suitable coupling interface, to couple the staged hole opener 180 to the RSS tool 64. In some embodiments, the bottom connection 188 is configured to rotatably couple the staged hole opener 180 to the RSS tool 64, thereby enabling the RSS tool 64 to rotate independently of the staged hole opener 180.

Figure 7:
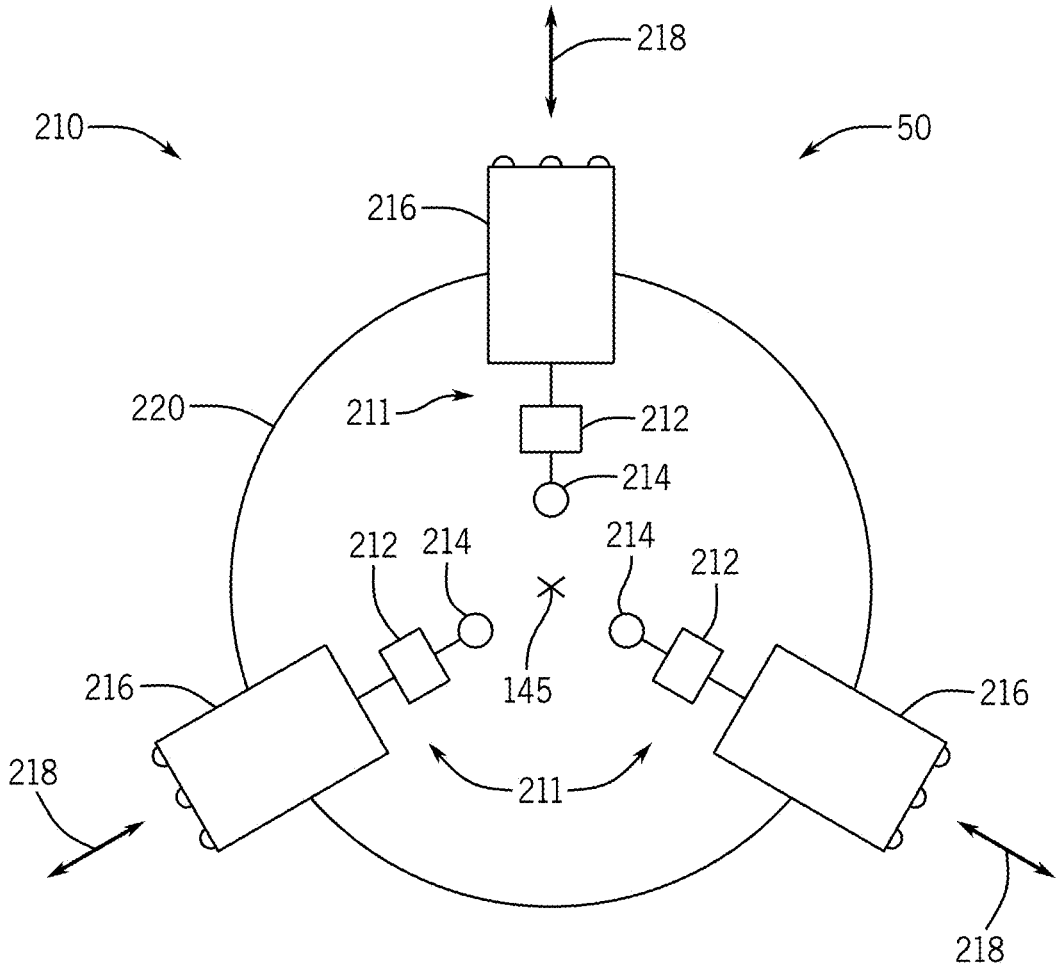
FIG. 7 is a section view through an embodiment of an expandable reamer, in accordance with aspects of the present disclosure.

FIG. 7 illustrates a schematic cross-sectional view of an embodiment of the reamer 50 of the BHA 34 of FIGS. 1-4, further illustrating an expandable reamer 210 that may be employed as the reamer 50 to provide the third point of contact 62. As illustrated, the expandable reamer 210 includes a plurality of blades 216, with each blade 216 coupled to a drive 211 configured to radially adjust (e.g., radially extend or radially retract) the blade 216 in response to control by a controller (e.g., steering controller 92). In particular, the controller (e.g., steering controller 92) may be configured to control the drive 211 for each blade 216 independently or in combination with one another, such that the blades 216 can be actuated to adjust the third point of contact 62. The drive 211 may include an electric drive, a fluid drive, or any combination thereof. In the illustrated embodiment, the drive 211 includes a fluid drive comprising a respective expandable reamer piston-cylinder assembly 212 (e.g., piston that reciprocates with a cylinder) and reamer valve 214. In the illustrated embodiment, the expandable reamer 210 includes three (3) blades 216. However an expandable reamer 210 with fewer or more (e.g., 2, 4, 5, 6, 7, 8, etc.) blades 216 is considered within the scope of the various embodiments of the present disclosure. As discussed in further detail below, each blade 216 is configured to actuate along a direction of movement 218 (e.g., radial path of travel oriented in a radial direction relative to a central axis 145 of the BHA 34) that corresponds to the individual blade 216. In the illustrated embodiment, the direction of movement 218 of each blade 216 is normal to an outer surface of a stabilizer portion 220 of the expandable reamer 210. Additionally or alternatively, the blade 216 is configured to actuate along a path substantially aligned with the indicated direction of movement 218. At one end of the path, the blade 216 may protrude outside of the outer surface of the stabilizer portion 220 (e.g., annular exterior surface or wall) of the expandable reamer 210 and at an opposite end of the path, the blade 216 may retract within the outer surface of the stabilizer portion 220.

In a non-limiting embodiment, the expandable reamer piston-cylinder assembly 212 and the reamer valve 214 function together to control the actuation of the blade 216 along the path and the illustrated direction of movement 218. In certain embodiments, the reamer valve 214 is fluidly coupled to a mud control valve via a pressurized mud line. The reamer valve 214 is configured to receive drilling fluid from the mud control valve and the pressurized mud line, and thereby output the received drilling fluid to the expandable reamer piston-cylinder assembly 212 in order to actuate the blade 216 along the movement path from a radially retracted position to a radially protruded position. In certain embodiments, the reamer valve 214 is configured to direct drilling fluid to a first side of a piston of the expandable reamer piston-cylinder assembly 212 to actuate the piston to push the blade 216 into a radially protruded position. Additionally, the reamer valve 214 is configured to direct drilling fluid to a second side of the piston of the expandable reamer piston-cylinder assembly 212 to actuate the piston to pull the blade 216 into a radially retracted position.

Figure 8:
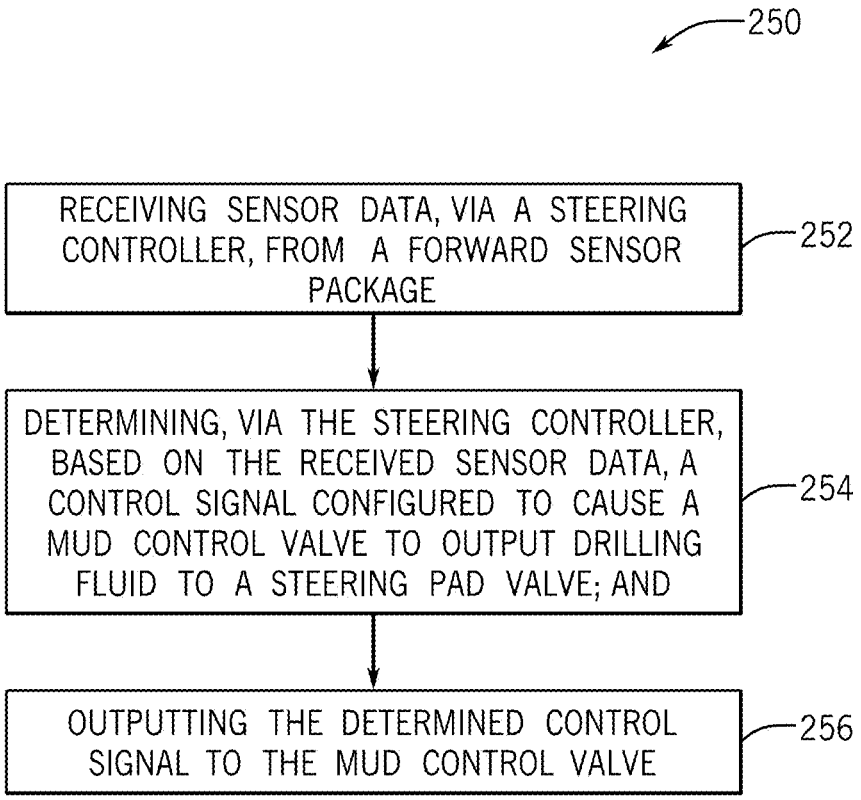
FIG. 8 is a flowchart of an embodiment of a method for operating the RSS tool and reamer while directional drilling through subterranean terrain, in accordance with aspects of the present disclosure.

FIG. 8 illustrates a flowchart of an embodiment of a method 250 for operating a steering control system during directional drilling operations. In particular, the method 250 operates the BHA 34 of FIGS. 1-7 to vary the points of contact 58, 60, and 62 to define the arc shaped profile 56 for maneuverable directional drilling. The method 250 is taken in context of the drill bit 20 defining the first point of contact 58, the steering pad assembly 54 defining the second point of contact 60, and the reamer 50 defining the third point of contact 62. At block 252, a steering controller receives sensor data from a forward sensor package. The sensor data may include drilling operational parameters, including but not limited to, drilling fluid pressure, drilling fluid flow rate, or any other suitable parameter. The steering controller may receive the sensor data at pre-determined intervals (e.g., every second, every 30 seconds, every minute, etc.). In other embodiments, the steering controller may be configured to continuously receive and monitor the sensor data.

At block 254, the steering controller may determine, based on the received sensor data, a control signal that is configured to cause a mud control valve to output drilling fluid to a steering pad valve of a steering pad assembly defining the second point of contact 60. For example, if during directional drilling operations, the RSS tool is cutting the curved path at an angle below a particular threshold, the steering controller may output a control signal to increase an operating parameter (e.g., drilling fluid pressure, drilling fluid flow rate, etc.) that the steering controller is outputting to the mud control valves. Additionally or alternatively, if during directional drilling operations, the RSS tool is cutting a curved path at an angle greater than a particular threshold, the steering controller may output a control signal to decrease an operating parameter (e.g., drilling fluid pressure, drilling fluid flow rate, etc.) that the steering controller is outputting to the mud control valves. At block 256, the steering controller may output the determined control signal to the mud control valve. Thus, the method 250 controls the directional steering of the BHA 34 at least by adjusting the second point of contact 60 via the steering pad assembly, defining in part the arc profile path of the BHA 34. In certain embodiments, the method 250 may further control the directional steering of the BHA 34 by adjusting the reamer 50 (e.g., expandable reamer 210) as discussed above with reference to FIG. 7.

The technical effect of the disclosed embodiments includes improved steering and maneuvering of a BHA 34 via a compact arrangement of three points of contact 58, 60, and 62 via the drill bit 20, the steering pad assembly 54, and the reamer 50, rather than relying on a third point of contact along the drill string 18 further away from the BHA 34 and the reamer 50. In the illustrated embodiment, the three points of contact 58, 60, and 62 may be within a total axial distance of less than or equal to 1, 1.5, 2, 2.5, or 3 meters. By using the reamer 50 as the third point of contact 62, the BHA 34 can be controlled to turn with sharper turns (e.g., smaller radii of curvature), less time to make changes in direction (e.g., real-time or substantially real-time turning), and more responsive to sensed conditions in the subterranean formations.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a bottom hole assembly (BHA), comprising:

a drill bit disposed at a first axial position, wherein the drill bit is configured to rotate and drill a pilot hole in a subterranean formation, wherein the drill bit provides a first point of contact between the BHA and the subterranean formation;

a steering pad assembly disposed at a second axial position offset from the first axial position, wherein the steering pad assembly comprises one or more steering pads each configured to move over a path of travel between a retracted position and an extended position to provide a second point of contact between the BHA and the subterranean formation;

a reamer disposed at a third axial position offset from the first and second axial positions, wherein the reamer is configured to expand the pilot hole into a borehole, wherein the reamer provides a third point of contact between the BHA and the subterranean formation; and an adjustable bend portion between the reamer and the drill bit, wherein a rotary steerable system (RSS) is configured to control the adjustable bend portion alone or in combination with the steering pad assembly; and a controller of the RSS configured to steer the BHA via the first, second, and third points of contact and adjustments to the second point of contact via control of the steering pad assembly.

2. The system of claim 1, wherein the first point of contact is provided by a first midpoint along a first axial length of the drill bit, the second point of contact is provided by a second midpoint along a second axial length of the steering pad assembly, and the third point of contact is provided by a third midpoint along a third axial length of the reamer.

3. The system of claim 2, wherein the first, second, and third points are within an axial distance of less than or equal to 2.5 meters.

4. The system of claim 1, wherein the first and second points of contact are separated by a first axial distance and the first and third points of contact are separated by a second axial distance, wherein the steering pad assembly is configured to move axially between the drill bit and the reamer to adjust a ratio of the first axial distance divided by the second axial distance.

5. The system of claim 1, wherein the reamer comprises at least one stabilizer portion and at least one cutter portion.

6. The system of claim 5, wherein the reamer is a one-piece reamer having the at least one stabilizer portion and the at least one cutter portion.

7. The system of claim 5, wherein the at least one stabilizer portion comprises a smooth surface devoid of any cutting elements, and the at least one cutter portion comprises a plurality of cutting elements.

8. The system of claim 1, wherein the reamer comprises a fixed diameter reamer, a staged hole opener, or an expandable reamer.

9. The system of claim 1, wherein the steering pad assembly comprises a plurality of the steering pads each coupled to a drive operated by the controller.

10. The system of claim 9, wherein each drive comprises a piston-cylinder assembly, and the steering pad assembly comprises a valve configured to control a flow of mud to each drive.

11. The system of claim 1, comprising:

a forward sensor package configured to monitor a plurality of drilling parameters, wherein the forward sensor package is communicatively coupled to the controller.

12. The system of claim 1, wherein the controller of the RSS is configured to steer the BHA via only the first, second, and third points of contact without any additional points of contact for directional steering.

13. A system, comprising:

a controller of a rotary steerable system (RSS) configured to control a bottom hole assembly (BHA), comprising:

a drill bit disposed at a first axial position, wherein the drill bit is configured to rotate and drill a pilot hole in a subterranean formation, wherein the drill bit provides a first point of contact between the BHA and the subterranean formation;

a steering pad assembly disposed at a second axial position offset from the first axial position, wherein the steering pad assembly comprises one or more steering pads each configured to move over a path of travel between a retracted position and an extended position to provide a second point of contact between the BHA and the subterranean formation;

a reamer disposed at a third axial position offset from the first and second axial positions, wherein the reamer is configured to expand the pilot hole into a borehole, wherein the reamer provides a third point of contact between the BHA and the subterranean formation; and a pivot joint disposed at a fourth axial position, and an axial distance between the third and fourth axial positions is less than or equal to 1 meter;

wherein the controller is configured to steer the BHA via the first, second, and third points of contact and adjustments to the second point of contact via control of the steering pad assembly.

14. The system of claim 13, wherein the first point of contact is provided by a first midpoint along a first axial length of the drill bit, the second point of contact is provided by a second midpoint along a second axial length of the steering pad assembly, and the third point of contact is provided by a third midpoint along a third axial length of the reamer, wherein the first, second, and third points are within an axial distance of less than or equal to 2.5 meters.

15. The system of claim 13, wherein the first and second points of contact are separated by a first axial distance and the first and third points of contact are separated by a second axial distance, wherein the steering pad assembly is configured to move axially between the drill bit and the reamer to adjust a ratio of the first axial distance divided by the second axial distance.

16. A method, comprising:

controlling steering of a bottom hole assembly (BHA) via a controller of a rotary steerable system (RSS), wherein the BHA comprises:

a drill bit disposed at a first axial position, wherein the drill bit is configured to rotate and drill a pilot hole in a subterranean formation, wherein the drill bit provides a first point of contact between the BHA and the subterranean formation;

a steering pad assembly disposed at a second axial position offset from the first axial position, wherein the steering pad assembly comprises one or more steering pads each configured to move over a path of travel between a retracted position and an extended position to provide a second point of contact between the BHA and the subterranean formation;

a reamer disposed at a third axial position offset from the first and second axial positions, wherein the reamer is configured to expand the pilot hole into a borehole, wherein the reamer provides a third point of contact between the BHA and the subterranean formation; and at least one of a pivot joint disposed at a fourth axial position or an adjustable bend portion between the reamer and the drill bit, wherein an axial distance between the third and fourth axial positions is less than or equal to 1 meter, and the RSS is configured to control the adjustable bend portion alone or in combination with the steering pad assembly;

wherein controlling steering comprises steering the BHA via the first, second, and third points of contact and adjustments to the second point of contact via control of the steering pad assembly.

17. The method of claim 16, wherein the first point of contact is provided by a first midpoint along a first axial length of the drill bit, the second point of contact is provided by a second midpoint along a second axial length of the steering pad assembly, and the third point of contact is provided by a third midpoint along a third axial length of the reamer, wherein the first, second, and third points are within an axial distance of less than or equal to 2.5 meters.

18. The method of claim 16, wherein the first and second points of contact are separated by a first axial distance and the first and third points of contact are separated by a second axial distance, wherein the steering pad assembly is configured to move axially between the drill bit and the reamer to adjust a ratio of the first axial distance divided by the second axial distance.

* * * * *